United States Patent [19]

Perrin

[11] 4,013,240

[45] Mar. 22, 1977

[54] ROLL SUPPORTING AND AUTOMATIC DISMOUNTING MECHANISM FOR ROLL TOWEL DISPENSERS AND METHOD OF USING

[75] Inventor: Jack Louis Perrin, Los Angeles, Calif.

[73] Assignee: Towlsaver, Inc., Los Angeles, Calif.

[22] Filed: Mar. 11, 1976

[21] Appl. No.: 665,895

[52] U.S. Cl. ..... 242/55.53; 242/68.4

[51] Int. Cl.[2] ..... A47K 10/32; A47K 10/22; A47K 10/16

[58] Field of Search ..... 242/55.53, 55.2, 55.3, 242/55.55, 68.5, 68.4, 55, 1; 206/389, 398; 312/39

[56] References Cited

UNITED STATES PATENTS

| | | | |
|---|---|---|---|
| 2,380,644 | 7/1945 | Grondona | 242/55.2 |
| 2,726,823 | 12/1955 | Jespersen | 242/55.53 |
| 3,010,669 | 11/1961 | Layton | 242/68.4 X |
| 3,089,659 | 5/1963 | Perrin | 242/55.2 |
| R25,828 | 8/1965 | Wooster | 242/55.2 |

*Primary Examiner*—George F. Mautz
*Attorney, Agent, or Firm*—Mahoney, Schick & Cislo

[57] ABSTRACT

A rotatable first roll end holder has diametrically opposed pins radially surrounded and projecting axially from radial surfaces except at pin inner radial extremities where a recess extends radially between the pins and opens axially toward the roll to be supported. The recess preferably also opens radially at opposite sides of the first holder. A second roll end holder may consist of merely a central projection so that a roll of toweling may be supported between said holders by simultaneous axially engagement of the pins and central projection. When sufficient toweling is dispensed from the roll to the pin inner radial extremities, the roll is released radially by the pins and pivots about the second holder projection through the first holder recess for ultimate complete disengagement from the holder. The first holder may be rotatably secured to a support axially pivotal about a vertical axis and a finger projection may be formed on the first holder as an extension of the recess with counterweighting of the first holder urging the holder to rotate with the finger projection extending horizontally and thereby permitting axial finger pressure against the finger projection to axially pivot the first and its support away from roll end engagement position to permit such engagement. Also, a circumferentially extending, axial projection extending circumferentially less than one-half a circumference may be on the second holder axially received in a circumferential groove of the roll radially outwardly of the second holder central projection to adapt the holder combination to different configurations of roll ends.

31 Claims, 8 Drawing Figures

ROLL SUPPORTING AND AUTOMATIC DISMOUNTING MECHANISM FOR ROLL TOWEL DISPENSERS AND METHOD OF USING

BACKGROUND OF THE INVENTION

This invention relates to a novel roll supporting and automatic dismounting mechanism for roll towel dispensers usable in a novel manner. Not only are the rolls efficiently supported for toweling dispensing by structure which lends itself to greater efficiencies in roll toweling production, but such structure automatically dismounts the particular roll being supported after a predictable percentage of toweling dispensing so as to automatically prepare the roll supporting mechanism for a fresh roll of toweling. Furthermore, the improvements of the present invention may include a particular formation of the mechanism providing greater convenience during the roll refilling operation, as well as additional structure components adding to the versatility of the mechanism.

Many forms of roll towel dispensers have heretofore been provided and certain of the same have included roll automatic dismounting after a predicated amount of the toweling has been dispensed from the roll. In general, the dispenser is hollow box-like in configuration adapted for being wall mounted on a vertical wall surface and is usually selectively front opening for gaining access to the interior thereof to perform the toweling roll replacement operations. Furthermore, since this class of dispensers make use of rolls of toweling, the toweling is dispensed in continuous strip form downwardly from the dispenser during the operation thereof.

More particularly, the roll of toweling is rotatably supported within the dispenser with the main longitudinal axis thereof between roll end holders. The continuous strip of toweling is fed downwardly from the roll between a pair of rotatable dispensing rolls and from the dispensing rolls downwardly adjacent a cutting bar and from the dispenser. The roll of toweling is supported freely rotatable so that, upon selective rotation of the dispensing rolls by means of one of various forms of hand operating levers, the strip toweling is dispensed from the cabinet and ultimately severed against the cutting bar after a quantity thereof is so dispensed.

In automatic roll dismounting dispensers, the particular roll of toweling from which the strip of toweling is being dispensed is supported on the roll end holders so that once a given quantity of toweling has been unrolled and dispensed therefrom, the roll end holders, usually through a cooperative specific roll formation, physically release the roll and permit the same to drop downwardly within the cabinet into a particularly provided used roll recess. Since the strip of toweling being dispensed from the roll is still firmly retained between the selectively rotatable dispensing rolls despite the fact that the roll is now resting in this used roll recess of the cabinet, following rotation of the dispensing rolls for the dispensing operation will continue to draw the strip of toweling from the roll while the roll now slideably rotates within this recess, and there will be no interruption of a limited number of further dispensing operations. However, since the roll from which the strip of toweling is being dispensed is now displaced from the roll end holders, a fresh roll of toweling can be mounted between the roll end holders during a maintenance operation, the strip of toweling from the fresh roll positioned directed downwardly between the dispensing rolls simultaneously with the strip of toweling from the used roll and the strip of toweling from both the used and fresh rolls will be automatically dispensed simultaneously from the dispenser until the used roll is completely exhausted of toweling.

Basically, the most common manner of providing an automatic roll dismounting dispenser is to form the roll end holders with a specific cooperable roll formation so that retention of the roll of toweling by the roll end holders at at least one end of the roll is determined by the layers of toweling on the roll. In other words, the roll end holder and roll are cooperably formed such that the roll will be supported by the roll end holder properly rotatable for dispensing until a given number of layers of the toweling have been rotatably wound therefrom, at which time, a portion of the roll end holder is automatically exposed to automatically remove the roll support of that particular roll end holder and the roll thereby is automatically released through gravity to pivot endwise about the other roll end holder ultimately falling downwardly to come to rest within the dispenser used roll recess as hereinbefore described. It is this general form of automatic roll dismounting dispenser to which the improvements of the present invention are directed.

OBJECTS AND SUMMARY OF THE INVENTION

It is, therefore, an object of this invention to provide a roll supporting and automatic dismounting mechanism for roll towel dispensers wherein the roll of toweling is supported in dispensing position within the dispenser in a quite simple, but highly secure, manner for efficient rotating dispensing of the layers of toweling therefrom, but yet despite the simplicity of such support, the roll is very efficiently dismounted upon a predicted amount of the toweling being dispensed therefrom. According to principles of the present invention, one of the roll end holders is formed with circumferentially spaced, preferably diametrically opposed, pins which are equally radially spaced from the main longitudinal axis of the roll to be supported, such pins importantly being radially outwardly of any core of such roll and defining axial clearance for the roll end between such pins. Thus, with the particular roll end supported by the pins being received therein and the other end of the roll being centrally supported, the roll will be properly rotatably supported by the pins and axially opposed central support until a sufficient number of layers of toweling have been dispensed therefrom radially inwardly to the pin inner radial extremities, at which time, the roll end will be released from the pins automatically and be permitted to endwise pivot through the clearance between the pins about its centrally retained opposite end to ultimately disengage completely from the roll end holders and drop downwardly into the used roll recess of the dispenser.

It is a further object of this invention to provide a roll supporting and automatic dismounting mechanism for roll towel dispensers which, as a result of the use of the above described efficient roll supporting and dismounting structure, makes use of rolls of toweling which may be supplied for a minimum of added manufacturing costs despite the addition of the dismounting feature. Considering a standard roll of toweling usable in a dispenser which does not have the dismounting feature, such standard roll of toweling necessarily consists of a central core having the strip of toweling wound thereon and it is through the central core that the standard roll of toweling is rotatably supported in a standard dispenser. The only thing added to the roll of toweling to adapt it to the unique roll supporting and automatic dismounting mechanism of the present invention is the addition of the properly located pin holes since the other end of the roll is still centrally supported. Thus, only a quite simple and quite efficiently performed manufacturing operation is added with a minimum of increased roll manufacturing costs despite the increased dismounting advantages thereof.

It is also an object of this invention to provide a roll supporting and automatic dismounting mechanism for roll towel dispensers wherein, added to the unique supporting and automatic dismounting structure as hereinbefore generally described, is an additional unique structure operational feature supplying further convenience during the maintenance operation of restoring a fresh roll to the dispenser. In the preferred form, the roll end holder having the roll supporting pins secured thereto is rotatably mounted on a pivotal mounting member, such mounting member preferably being pivotal about a vertical axis and being capable of pivotally moving the roll end holder toward and away from its roll end supporting position in somewhat usual manner. However, the particular roll end holder has a finger projection formed thereon extending radially outwardly therefrom between the pin locations and the holder is further counterweighted so as to urge the holder to rotate to a position with the finger projection directed toward the front of the dispenser cabinet. Thus, with the original roll of toweling having been automatically dismounted as hereinbefore described and the holder counterweighting having performed its function, the finger projection will be positioned extending forwardly and readily engageable to pivot the holder structure outwardly so that the holder pins can be readily inserted into the end of a fresh roll of toweling being mounted in the dispenser.

It is still another object of this invention to provide a roll supporting and automatic dismounting mechanism for roll towel dispensers offering any or all of the foregoing advantages, yet which may include additional structure adding versatility thereto for adaption of the same to various forms of toweling rolls usable with other supporting and dismounting structure. As hereinbefore pointed out, roll supporting and automatic dismounting mechanisms of various other types have heretofore been provided so that rolls of toweling are manufactured specifically for these other forms of mechanisms. Through some unique added structure to the mechanism of the present invention, it is possible to adapt the same such that a highly versatile form of toweling roll may be produced usable with either this or other mechanism forms and the mechanism of the present invention may even be provided capable of slight alteration for use of certain prior types of dismounting mechanisms, with the present pin supporting mechanism merely assuming a normal roll end supporting function.

Other objects and advantages of the invention will be apparent from the following specification and the accompanying drawings which are for the purpose of illustration only.

DESCRIPTION OF THE BEST EMBODIMENTS CONTEMPLATED

Figure 1:
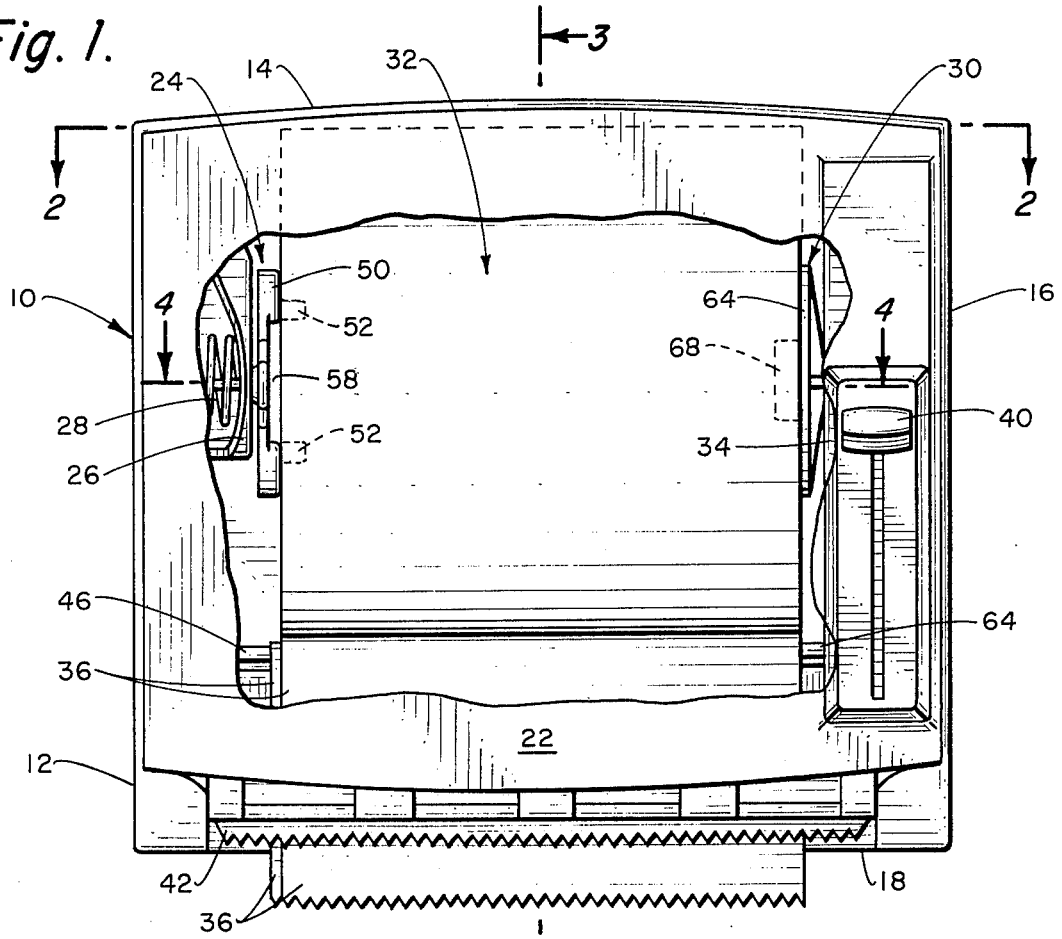
FIG. 1 is a front elevational view of a somewhat typical roll towel dispenser incorporating the unique roll supporting and automatic dismounting mechanism of the present invention, the dispenser having the front access door thereof partially broken away to more clearly show certain of the details of the mechanism.
Figure 2:
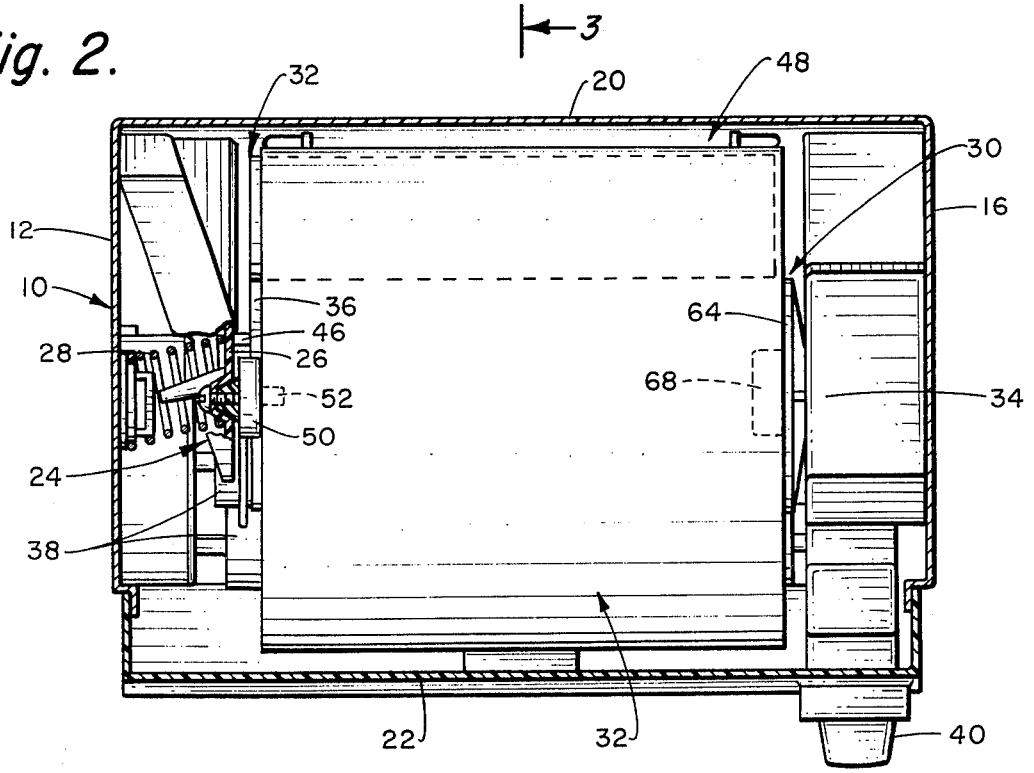
FIG. 2 is a horizontal sectional view looking in the direction of the arrows 2—2 in FIG. 1.
Figure 3:
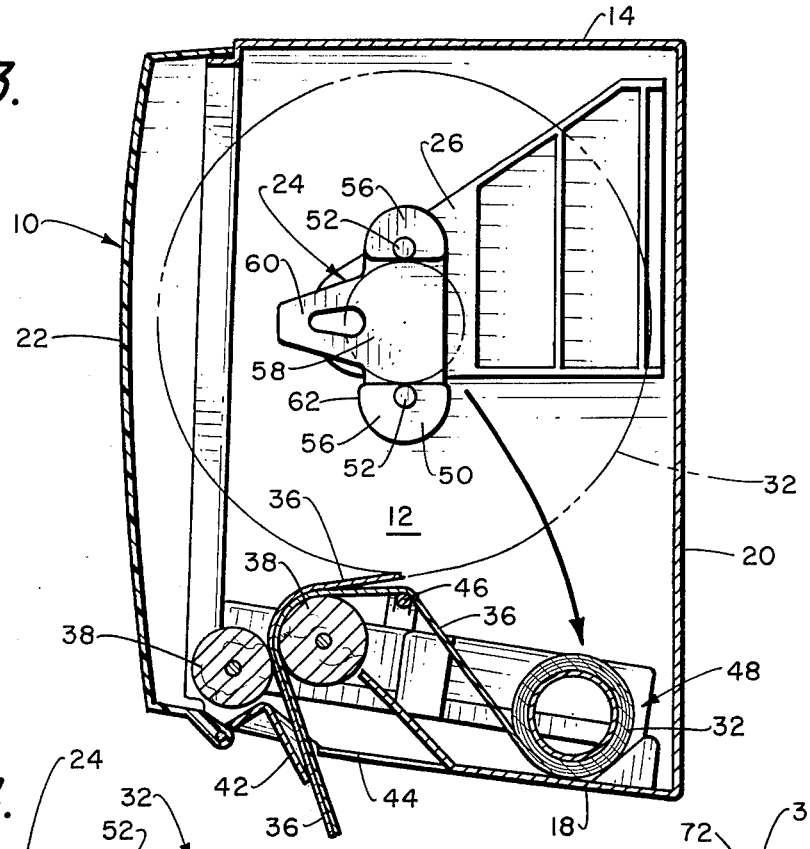
FIG. 3 is a vertical sectional view looking in the direction of the arrows 3—3 in FIG. 1.

Referring first to FIGS. 1 through 3 of the drawings, a somewhat typical roll towel dispenser is illustrated generally indicated at 10 incorporating the unique roll supporting and automatic dismounting mechanism of the present invention. The cabinet of the dispenser 10 is hollow box-like preferably formed of sheet metal and including rigidly connected left sidewall 12, top wall 14, right sidewall 16, bottom wall 18 and back wall 20. A plastic front wall 22 is hingedly mounted on a forward portion of the bottom wall 18 and may be selectively hinged forwardly to fully expose the interior of the dispenser 10.

Without for the moment getting in to the details of the roll supporting and automatic dismounting mechanism of the present invention, a first or lefthand roll end holder generally indicated at 24 is mounted at an upper central portion of the left sidewall 12 through rotatable securement to a mounting member 26 which extends rearwardly and is pivotally connected to the left sidewall, pivotal about a vertical axis in somewhat usual manner. Also in somewhat usual manner, the mounting member 26 is urged pivotally outwardly away from the left sidewall 12 by a compression spring 28 to assume an outer toweling roll engaging position spaced a maximum from the left sidewall. With this pivotal mounting of the mounting member 26, however, the first roll end holder 24 and its mounting member 26 may be selectively pivoted toward the left sidewall 12 compressing the spring 28 in order to permit a toweling roll refilling operation as will be hereinafter described.

When in its outer toweling roll engaging position, the first roll end holder 24 is axially aligned with a second or righthand roll end holder generally indicated at 30, the latter being axially spaced therefrom generally the axial width of a roll of toweling generally indicated at 32 mounted therebetween and shown so mounted in FIGS. 1 and 2. The second roll end holder 30 is rotatably secured to a mounting member 34 which is rigidly connected to the cabinet right sidewall 16. Thus, the roll of toweling 32 is rotatably supported axially between the first and second roll end holders 24 and 30 positioned for directing or dispensing a continuous strip of toweling 36 rearwardly and downwardly, ultimately between a pair of dispensing rolls 38 adjacent the cabinet bottom wall 18.

The dispensing rolls 38 are rotatably mounted radially aligned with and axially coextensive with the roll of toweling 32 when supported between the first and second roll end holders 24 and 30. In usual manner, one of these dispensing rolls 38 is radially compressively mounted bearing against the other of such dispensing rolls with the latter dispensing roll being selectively rotatably driven in any usual manner such as a vertically reciprocal operating lever 40 as generally shown in FIGS. 1 and 2. Furthermore, the dispensing rolls 38 directly overly a serrated cutter bar 42 which defines the forward extremity of a cabinet dispensing slot generally indicated at 44 formed in the cabinet bottom wall 18. Finally as to the general structure of the dispenser 10, a shunting bar 46 is supported between the cabinet sidewalls 12 and 16 spaced rearwardly of the upper extremities of the dispensing rolls 38 directly underlying the roll of toweling 32 and forwardly of a cabinet used roll recess 48 for purposes to be hereinafter described.

With the strip of toweling 36 directed downwardly between the dispensing rolls 38, therefor, actuation of the operating lever 40 will dispense the strip of toweling 36 downwardly through the dispensing slot 44 and from the dispenser 10. When the desired length of the strip of toweling 36 has been so dispensed, the same may be severed from the main strip of toweling by usual forward urging of the same against the cutter bar 42. Also, since this is an automatic roll dismounting dispenser, when the roll of toweling 32 supported between the first and second roll end holders 24 and 30 is unrolled and dispensed to a determined degree, the roll of toweling is automatically released from the first and second roll end holders falling downwardly against and being shunted rearwardly of the shunting bar 46 to come to rest in the used roll recess 48 as best seen in FIG. 3, with the strip of toweling 36 therefrom still being engaged between the dispensing rolls 38. Thus, a fresh roll of toweling may then be positioned supported between the first and second roll end holders 24 and 30 with its strip of toweling directed between the dispensing rolls 38 forwardly overlying the original strip of toweling so that both strips of toweling will then be dispensed from the dispenser 10 until the used roll within the used roll recess 48 is consumed.

More particularly to the embodiment of the supporting and automatic dismounting mechanism principles of the present invention, these principles basically involve the first and second roll end holders 24 and 30, as well as certain of the mounting thereof and the particular structure of the roll of toweling 32 for being adapted thereto. First referring to FIGS. 1 through 5 and 7, the first or lefthand roll end holder 24 includes a preferably molded plastic, one-piece holder member 50 rotatably secured to the mounting member 26 and having formed thereon preferably two axially inwardly projecting and diametrically opposite pins 52. The pins 52 are substantially identical in outer contour and are equally radially spaced from the axis of rotation of the holder member 50 and the central longitudinal axis of the roll of toweling 32 retained thereon. Also of importance, the pins 52 are radially positioned so as to be radially outwardly of any core 54 of the roll of toweling 32.

Tangentially of the radially inner extremities of the pins 52 and radially outwardly thereof radially surrounding the pins, the holder member 50 is formed with radially extending, roll end abutment surfaces 56. At the inner radial extremities of the pins 52, the roll end abutment surfaces 56, in effect, define an axially outwardly extending roll clearance space or recess 58 totally radially between the pin inner radial extremities. The recess 58 extends in a vertical plane at least as large as an imaginary circumferential line defined by the inner radial extremities of the pins 52 (FIG. 3) and in the preferred embodiment shown, the recess is a generally rectangular recess opening radially at opposite sides of the holder member 50 between the pins 52 as shown. Thus, the pins 52 project axially from the roll end abutment surfaces 56 with extremities spaced axially therefrom and the recess 58 projects axially oppositely from the roll end abutment surfaces 56 provided a clearance space radially inwardly of the pins within the holder member 50.

The holder member 50 is also formed with a finger projection 60 extending radially therefrom as a radial extension of the recess 58. As can be best seen in FIG. 4, the holder member 50 at one of the pins 52 is formed hollow and at the other pin 52 is formed solid so that the solid formation constitutes a counterweight 62 tending to urge that portion of the holder member to rotate downwardly and place the finger projection 60 in a generally horizontally extending position. As best illustrated in FIG. 3, when one of the rolls of toweling 32 is not being supported by this holder member 50, the counterweight 62 causes the holder member to rotate placing the finger projection 60 extending forwardly of the dispenser 10 so that, upon opening of the front wall 22, the finger projection 60 may be effectively used to pivot the first roll end holder 24 and its mounting member 26 outwardly toward the dispenser left sidwall 12 to permit a fresh roll of toweling to be inserted and engaged by the first roll end holder.

The second or righthand roll end holder 30 includes a preferably molded plastic, one-piece holder member 64 rotatably secured to its mounting member 34 axially aligned with the holder member 50 of the first roll end holder 24. An inwardly facing, flat radially extending, roll end abutment surface 66 is formed on the holder member 64 which terminates radially inwardly in a central, axially inwardly projecting, cylindrical member 68 of appropriate size to be endwise received in and support one end of the core 54 of the roll of toweling 32. With the exception of the cylindrical member 68, the roll end abutment surface 66 of this first embodiment holder member 64 is radially uninterrupted.

The roll of toweling 32 for proper support by the holder members 50 and 64 of the first and second roll end holders 24 and 30 merely requires diametrically opposite, axially extending pin openings or holes 70 to be formed therein sufficiently deep to receive the pins 52 of the holder member 50. Obviously, these roll pin holes 70 will be equally radially spaced from the main longitudinal axis of the roll of toweling 32 and will be radially outwardly of the core 54 thereof as hereinbefore described relative to the placement of the holder member pins 52. Otherwise, the roll of toweling 32 has conventional straight radially extending end surfaces 72 formed by the wound strip of toweling 36.

Figure 4:
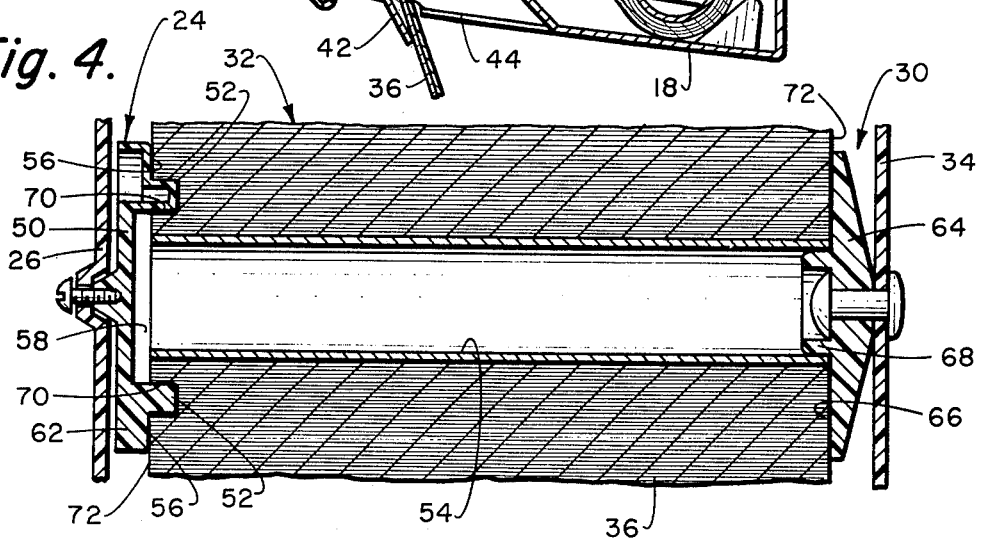
FIG. 4 is an enlarged, fragmentary, horizontal sectional view looking in the direction of the arrows 4—4 in FIG. 1, but showing the roll supporting and automatic dismounting mechanism rotated ninety degrees and having a relatively large roll of toweling supported thereon in position during dispensing.

Thus in use, starting with an empty dispenser 10, the finger projection 60 of the holder member 50 is hand urged pivotally toward the dispenser left sidewall 12 and a fresh roll of toweling 32 is inserted engaging the right end of the core 54 thereof over the cylindrical member 68 to the holder member 64 abutting the roll end surface 72 of this right side against the roll end abutment surface 66 of this holder member 64. The holder member 50 at the left end of the roll of toweling 32 is then permitted to pivot inwardly, the roll being aligned so that the holder member pins 52 are received in the roll pin holes 70 and the left roll end surface 72 abuts against the roll end abutment surfaces 56, all in the final mounted position as shown in FIG. 4. The strip of toweling 36 of the roll 32 is, of course, then fed downwardly between the dispensing rolls 38 (FIG. 3) thereby placing the dispenser 10 ready for operation.

Figure 5:
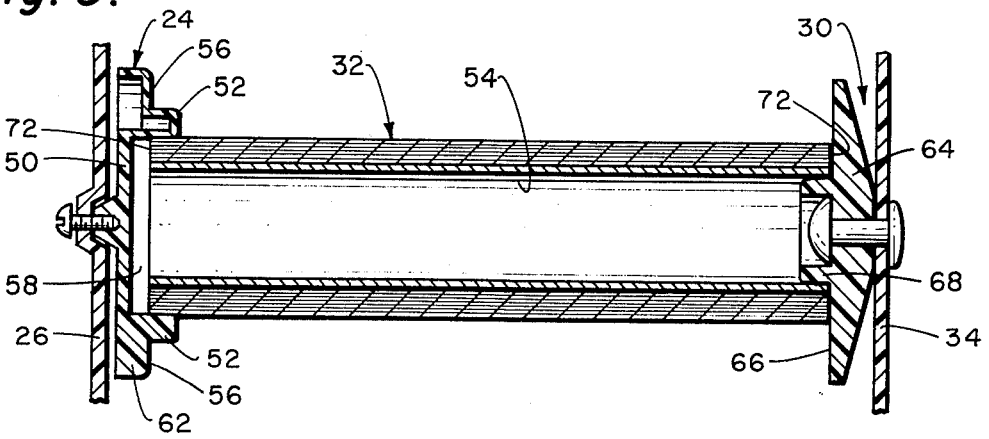
FIG. 5 is a view similar to FIG. 4, but with a sufficient amount of the toweling having been dispensed from the roll to start action of the automatic dismounting portion of the mechanism.

After a sufficient amount of the strip of toweling 36 on the roll 32 has been dispensed so that the outermost of the strip of toweling is just inwardly of the radially inner extremities of pins 52 on the left holder member 50 as shown in FIG. 5, the next time that the holder member 50 rotates to a position in which the recess 58 thereof opens at either side downwardly, the remaining portion of the roll of toweling 32 will fall by gravity endwise downwardly between the pins and from the holder member, that is, endwise pivoting about the cylindrical member 68 of the holder member 64 at the right side of the roll. Clearance for such endwise pivoting of the now reduced roll of toweling 32 is provided by the recess 58 of the holder member 50 and ulitmately permits the roll to also completely disengage from the right holder member 64. Upon such complete disengagement and with the strip of toweling 36 still extending between and engaged by the dispensing rolls 38, the used roll of toweling 32 will drop downwardly and either against and then rearwardly of or rearwardly of the shunting bar 46 into the dispenser used roll recess 48 in the position shown in FIG. 3, thereby completing the automatic roll dismounting operation.

Thus, upon disengagement of the strip of toweling 36 of the now used roll of toweling 32 from the holder member pins 52 at the left side, the automatic roll dismounting action takes place depositing the used roll in the used roll recess 48 of the dispenser 10, but continued dispensing of the strip of toweling 36 from the roll may continue until the used roll is depleted. Assuming that a maintenance operation occurs prior to such depletion, a fresh roll of toweling 32 may be mounted engaged by the holder members 50 and 64 as previously described and the strip of toweling 36 thereof may be fed downwardly between the dispensing rolls 38 overlying the already positioned strip of toweling. Dispensing of a double strip of toweling in the manner shown in FIG. 3 may continue until the used roll of toweling within the dispenser used roll recess 48 is exhausted.

Figure 6:
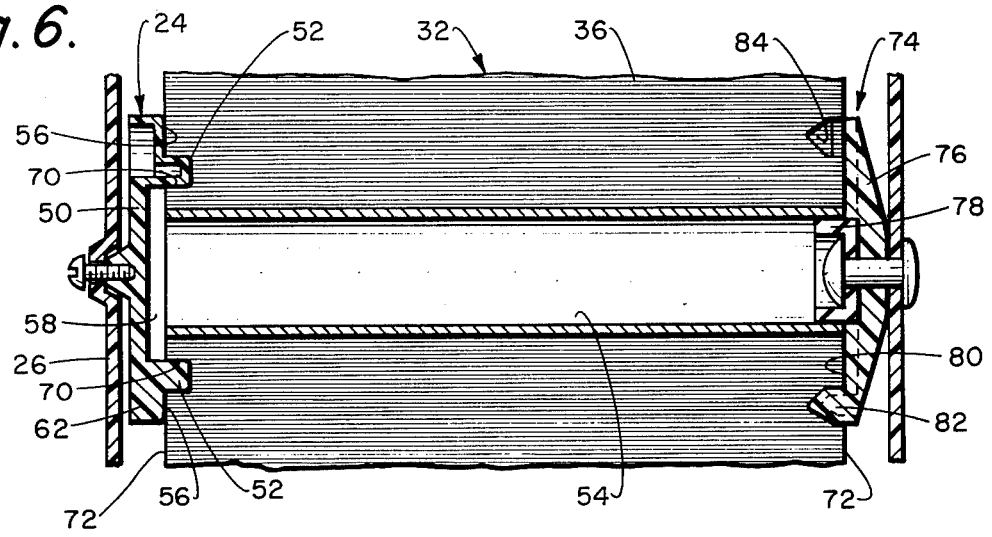
FIG. 6 is a view similar to FIG. 4, but of a slightly altered form of the supporting and automatic dismounting mechanism of the present invention for adapting the same to slightly different forms of rolls of toweling.
Figure 7:
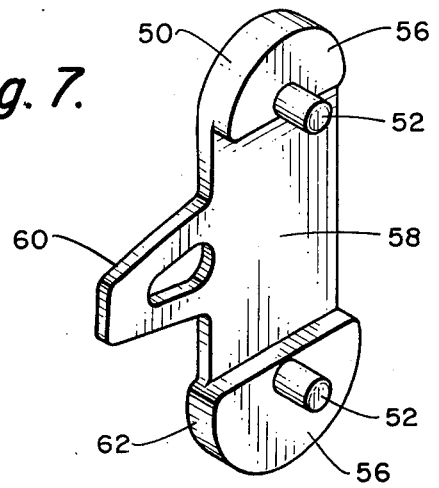
FIG. 7 is an enlarged, perspective view of the first or lefthand roll end holder disassembled from any one of FIGS. 1 through 6.
Figure 8:
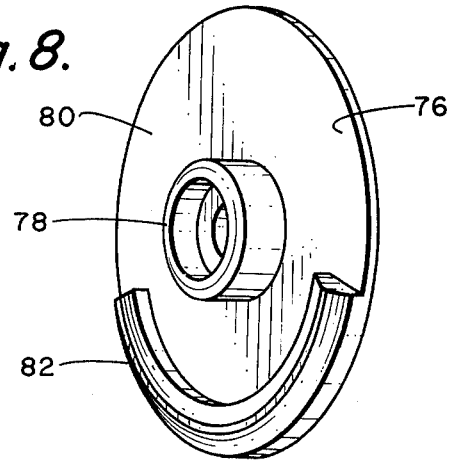
FIG. 8 is an enlarged perspective view of the second or righthand roll end holder disassembled from FIG. 6, but likewise sufficiently illustrating the second or righthand roll end holder of FIGS. 1 through 5.

A slightly modified second embodiment of the roll supporting and automatic dismounting mechanism of the present invention is illustrated in FIGS. 6 and 8 and the only change therein is a slightly modified second or righthand roll end holder generally indicated at 74, that is, a holder member 76 thereof. As shown, a same central cylindrical member 78 is provided, but selectively detachable from the holder member 76, and a generally same radially extending, roll end abutment surface 80, but modified by a circumferential, axially extending projection 82 of a general form known from prior roll dismounting structures. The circumferential projection 82 extends less than ½ of a circumference and is spaced radially outwardly a greater distance than the pins 52 of the left holder member 50. The roll of toweling 32 is adapted to this modification merely by the addition of an annular slot 84 in the right roll end surface 72 aligned for axial reception of the holder member circumferential projection 82.

The purpose of this modified form is to add versatility to the structure for adaption of the same to various forms of toweling rolls usable with other supporting and dismounting structure. For instance, assume that the holder members 50 and 76 are used as shown in FIGS. 6 and 8 with the roll of toweling 32 as shown therein, the automatic dismounting of the roll will be precisely the same as described as determined by the holder member pins 52 and as released from the cylindrical member 78 with the circumferential projection 82 of the holder member 76 being ineffective. If, however, it is desired to provide the circumferential projection 82 of the holder member 76 effective for initiating the automatic roll dismounting operation, the cylindrical member 78 is removed, the right roll end surface 72 of the roll 32 is slightly axially recessed entirely radially inwardly of the circumferential projection 82 and this circumferential projection will be effective, with the pins 52 at the left holder member 50 only acting as release members upon the opposite endwise angled release of the roll of toweling caused by the circumferential projection 82.

According to the present invention, therefore, a roll supporting and automatic dismounting mechanism for roll towel dispensers is provided wherein the roll of toweling 32 is supported in dispensing position within the dispenser 10 in a quite simple, but highly secure, manner by the pins 52 of the unique holder member 50 at the one side and cooperable with merely the cylindrical member 68 of the holder member 64 at the other side. Furthermore, despite such simple support, the strip of toweling may be efficiently dispensed therefrom and equally important, this simple pin support provides for efficient automatic roll dismounting, all as hereinbefore described. Still further, due to the simple holder member pin support of the rolls of toweling 32, manufacture of such rolls is quite efficiently carried out at appreciable cost savings over prior similar constructions. Finally, certain additional elements have been added to the mechanism for adding to the convenience of refilling of the dispenser with fresh rolls of toweling 32 and for adapting the mechanism for use of slightly altered forms of rolls of toweling either in substantially the same manner or in a manner according to certain prior constructions, all adding to the efficiency of the mechanism and the versatility of the same as also hereinbefore described.

In the foregoing, the preferred embodiments of the roll supporting and automatic dismounting mechanism of the present invention have been described making use of the roll of toweling 32 having the usual rigid core 54. It is pointed out, however, that rolls of toweling formed without a central core and merely being solidly wound could be equally as well used with only slight alteration of the intended mechanism and that such alternate toweling roll constructions are fully contemplated within the principles of the present invention.

I claim:

1. In a roll supporting and automatic dismounting mechanism for roll towel dispensers; the combination of: a first roll end holder rotatable about a main longitudinal axis of a roll adapted to be supported thereby comprising circumferentially spaced axially projecting pins terminating axially in free ends towards the intended location of said roll, said pins being equally radially spaced from said roll longitudinal axis and being radially outwardly of any core of said roll, radially aligned roll end abutment means cooperable with each of said pins axially spaced from said pin free ends and effective to axially abut said roll at least tangentially adjacent radially inner extremities of said pins, axially outward recess means formed in said first holder extending axially outward of said abutment means, said recess means extending radially between said pin radially inner extremities and radially outwardly at least to a closed imaginary circumferential line circumscribed about said roll axis at said pin radially inner extremities; a second roll end holder comprising roll end support means adopted for generally axially releasably supporting an opposite end of said roll, said second holder support means being formed for releasing said roll opposite end upon dispensing of toweling of said roll progressively radially inwardly to said first holder pin radially inner extremities with said first holder recess means permitting said roll to pivot generally radially about said second roll holder and through said first holder recess means.

2. In a roll supporting and automatic dismounting mechanism as defined in claim 1 in which said first holder pins consist of diametrically opposite pins.

3. In a roll supporting and automatic dismounting mechanism as defined in claim 1 in which said first holder recess means includes a generally rectangular recess opening radially through at least one side of said first holder.

4. In a roll supporting and automatic dismounting mechanism as defined in claim 1 in which said first holder pins consist of diametrically opposite pins; and in which said first holder recess means includes a generally rectangular recess opening radially through opposite sides of said first holder radially between said first holder pins.

5. In a roll supporting and automatic dismounting mechanism as defined in claim 1 in which said roll end abutment means of said first holder includes generally radially extending surfaces tangentially adjacent opposite sides of each of said pins.

6. In a roll supporting and automatic dismounting mechanism as defined in claim 1 in which said first holder pins consist of diametrically opposite pins; in which said roll end abutment means of said first holder includes generally radially extending surfaces tangentially adjacent opposite sides of each of said pins; and in which said first holder recess means includes a generally rectangular recess radially between said roll end abutment means surfaces opening radially through opposite sides of said first holder between said pins.

7. In a roll supporting and automatic dismounting mechanism as defined in claim 1 in which said first holder is secured rotatable on a mounting member; in which said mounting member is axially pivotal carrying said first holder therewith generally axially outwardly from and inwardly to first holder roll engagement positioning; and in which said first holder includes generally radially extending finger projection means for selective finger engagement to move said first holder and mounting member generally axially.

8. In a roll supporting and automatic dismounting mechanism as defined in claim 1 in which said first holder is rotatably secured to a mounting member; in which said mounting member is mounted pivotal about a generally vertical axis carrying said first holder therewith movable outwardly from and inwardly to roll engagement positioning of said first holder; and in which said first holder includes radially extending finger projection means for selective engagement by a finger to pivot said first holder and said mounting member generally axially about said mounting member pivot axis, counterweight means upon said first holder rotatably positioning said first holder by gravity with said finger projection means extending generally horizontally relative to said mounting member pivotal axis.

9. In a roll supporting and automatic dismounting mechanism as defined in claim 1 in which said first holder pins consist of diametrically opposite pins; in which said first holder recess means includes a generally rectangular recess opening radially through opposite sides of said first holder radially between said first holder pins; in which said first holder is rotatably secured to a mounting member; in which said mounting member is mounted pivotal about a generally vertical axis carrying said first holder therewith movable outwardly from and inwardly to roll engagement positioning of said first holder; and in which said first holder includes radially extending finger projection means for selective engagement by a finger to pivot said first holder and mounting member generally axially about said mounting member pivot axis, counterweight means on said first holder rotatably positioning said first holder by gravity with said finger projection means extending generally horizontally relative to said mounting member pivotal axis, said finger projection means forming a radial continuation of said first holder recess.

10. In a roll supporting and automatic dismounting mechanism as defined in claim 1 in which said roll end support means of said second holder includes a generally cylindrical member positioned receivable in a hollow core of said roll.

11. In a roll supporting and automatic dismounting mechanism as defined in claim 1 in which said roll end support means of said second holder includes a generally axially extending projection thereon, said projection extending circumferentially of said second holder for a distance less than one-half said circumference, said projection being positioned adapted engageable in a circumferential recess of said roll, a roll end support projecting axially of said second holder spaced radially inwardly of said projection and adapted coaxially engageable with said roll.

12. In a roll supporting and automatic dismounting mechanism as defined in claim 1 in which said roll end support means of said second holder includes a cylindrical member positioned receivable in a core of said roll, an axially extending projection spaced radially outwardly of said cylindrical member, said projection extending circumferentially less than one-half a circumference and being positioned adapted engageable in a circumferential recess of said roll.

13. In a roll supporting and automatic dismounting mechanism supporting a roll of toweling in a dispenser; the combination of: first and second roll end holders; a roll of toweling endwise engaged between said roll holders rotatable about a main longitudinal axis dispensing toweling therefrom; said first roll holder being rotatable about said roll axis and comprising circumferentially spaced axially extending pins equally radially spaced from said roll axis and being radially outwardly of any core of said roll, said pins being axially engaged endwise in said roll, radially aligned roll end abutment means cooperable with each of said pins endwise abutting said roll at least tangentially adjacent radially inner extremities of said pins, roll end clearance means formed by said first roll holder for permitting roll endwise pivoting about said second roll holder upon dispensing of said roll toweling radially inwardly to said radially inner extremities of said first roll holder pins and release of said roll from said pins and said roll end abutment means of said first roll holder; said second roll holder comprising roll end support means for endwise supporting said roll during said toweling dispensing and releasing said roll during said roll endwise pivoting.

14. In a roll supporting and automatic dismounting mechanism as defined in claim 13 in which said first holder pins consist of diametrically opposite pins.

15. In a roll supporting and automatic dismounting mechanism as defined in claim 13 in which said roll end clearance means of said first holder includes a recess formed in said first holder opening axially toward said roll and opening radially through at least one side of said first holder.

16. In a roll supporting and automatic dismounting mechanism as defined in claim 13 in which said first holder pins consist of diametrically opposite pins; and in which said roll end clearance means of said first holder includes a generally rectangular recess radially between said pins opening axially toward said roll and opening radially through opposite sides of said first holder.

17. In a roll supporting and automatic dismounting mechanism as defined in claim 13 in which said roll end abutment means of said first holder includes generally radial surfaces on said first holder tangentially adjacent opposite sides of each of said pins.

18. In a roll supporting and automatic dismounting mechanism as defined in claim 13 in which said first holder pins consist of diametrically opposite pins; in which said end abutment means of said first holder includes radial surfaces on said first holder tangentially adjacent opposite sides of each of said pins; and in which said roll end clearance means of said first holder includes a generally rectangular recess formed in said first holder opening toward said roll radially between said pins and said end abutment means surfaces, said recess opening radially at opposite sides of said first holder.

19. In a roll supporting and automatic dismounting mechanism as defined in claim 13 in which said first holder is secured rotatable on a mounting member; in which said mounting member is secured pivotal generally axially outwardly away from and inwardly toward said roll carrying said first holder therewith; and in which said first holder includes a generally radially extending finger projection selectively engageable by a finger to move said first holder and support pivotally.

20. In a roll supporting and automatic dismounting mechanism as defined in claim 13 in which said first holder is secured rotatable on a support; in which said support is mounted axially pivotal about a generally vertical axis generally axially away from and toward said roll carrying said first holder therewith; and in which said first holder includes a radially extending finger projection selectively engageable by a finger to generally horizontally pivot said first holder and support relative to said roll, a counterweight on said first holder tending to rotate said first holder to a position with said finger projection extending generally horizontally.

21. In a roll supporting and automatic dismounting mechanism as defined in claim 13 in which said first holder pins consist of diametrically opposite pins; in which said roll end clearance means of said first holder includes a generally rectangular recess opening axially toward said roll radially between said pins and opening radially through opposite sides of said first holder; in which said first holder is secured rotatable on a support; in which said support is mounted pivotal generally horizontal about a generally vertical pivot axis and generally axially away from and toward said roll carrying said first holder therewith; and in which said first holder includes a finger projection extending generally radially and forming a radial continuation of said first holder recess, a counterweight on said first holder positioned tending to urge said first holder rotatably to a position with said finger projection extending generally horizontally.

22. In a roll supporting and automatic dismounting mechanism as defined in claim 13 in which said roll of toweling includes a hollow core; and in which said roll end support means of said second holder includes a cylindrical member axially positioned in said roll hollow core.

23. In a roll supporting and automatic dismounting mechanism as defined in claim 13 in which said roll of toweling includes a generally radially extending end surface axially facing said second roll holder, said roll end surface having a circumferential groove formed axially therein spaced radially outwardly of any roll core; and in which said roll end support means of said second holder includes a roll center support extending axially into said roll centrally thereof, a circumferentially extending projection received in said roll groove, said projection extending circumferentially less than one-half a circumference.

24. In a roll supporting and automatic dismounting mechanism as defined in claim 13 in which said roll of toweling includes a hollow core, said roll having a generally radially extending end surface axially facing said second holder, said roll end surface having a circumferential groove formed therein; and in which said roll end support means of said second roll holder includes a cylindrical center support positioned in said roll core, a circumferentially extending projection received axially in said roll end surface groove, said projection extending circumferentially less than one-half a circumference.

25. In a method of endwise supporting a roll of toweling during dispensing and automatically dismounting said roll; the steps of: supporting one end of a roll of toweling rotatable about a main longitudinal roll axis by axial pins equally radially spaced from said roll axis outwardly of any roll core and endwise engaged in said roll; supporting the other end of said roll rotatable about said roll axis; automatically releasing said roll one end from said pins and permitting said roll to endwise pivot about said roll other end by dispensing said roll toweling to inner radial extremities of said pins and providing clearance for said roll endwise pivoting; automatically releasing said other roll end after commencement of and during said roll endwise pivoting.

26. In a method of endwise supporting a roll of toweling as defined in claim 25 in which said step of automatically releasing said roll one end includes providing said clearance for said roll endwise pivoting by a recess of a holder opening axially toward said roll one end.

27. In a method of endwise supporting a roll of toweling as defined in claim 25 in which said step of supporting one end of a roll of toweling includes supporting said roll by two axial pins positioned diametrically opposite.

28. In a method of endwise supporting a roll of toweling as defined in claim 25 in which said step of supporting one end of a roll of toweling includes supporting said roll by two axial pins positioned diametrically opposite; and in which said step of automatically releasing said roll one end includes providing said clearance for said roll endwise pivoting by a recess of a roll end holder opening axially toward said roll one end and opening radially through said holder.

29. In a method of endwise supporting a roll of toweling as defined in claim 25 in which said step of supporting the other end of said roll includes supporting said other end of said roll at least centrally thereof aligned with said roll axis.

30. In a method of endwise supporting a roll of toweling as defined in claim 25 in which said step of supporting the other end of said roll includes supporting said other end of said roll centrally thereof aligned with said roll axis and at least during part of said dispensing of said roll toweling, supporting said other end of said roll spaced radially outwardly of said central supporting and radially outwardly of any core of said roll.

31. In a method of endwise supporting a roll of toweling as defined in claim 25 in which said step of supporting one end of a roll of toweling includes supporting one end of a roll of toweling having a core, supporting said roll by two axial pins positioned diametrically opposite of said main longitudinal roll axis and radially outwardly of said roll core; and in which said step of supporting the other end of said roll includes supporting said other end of said roll at least centrally thereof by a cylindrical member axially received within said roll core.

* * * * *